US009347756B2

(12) United States Patent
Sager et al.

(10) Patent No.: US 9,347,756 B2
(45) Date of Patent: May 24, 2016

(54) NON EXPLOSIVE PROCESS AND DEVICE FOR TRIGGERING AN AVALANCHE

(75) Inventors: David Allen Sager, Phoenix, AZ (US); Gavin Wade Washburn, Phoenix, AZ (US)

(73) Assignee: Gavin Washburn, Phoenix, AZ (US)

( * ) Notice: Subject to any disclaimer, the term of this patent is extended or adjusted under 35 U.S.C. 154(b) by 904 days.

(21) Appl. No.: 12/767,167

(22) Filed: Apr. 26, 2010

(65) Prior Publication Data

US 2011/0261645 A1 Oct. 27, 2011

(51) Int. Cl.

| | |
|---|---|
| ***B06B 1/06*** | (2006.01) |
| ***F42D 3/00*** | (2006.01) |
| ***F41H 13/00*** | (2006.01) |
| *B06B 1/00* | (2006.01) |

(52) U.S. Cl.

CPC ..... *F42D 3/00* (2013.01); *F41H 13/0081* (2013.01); *B06B 1/00* (2013.01)

(58) Field of Classification Search

CPC ..... B06B 1/00; F42D 3/00; F41H 13/0081
USPC ..... 102/302; 89/1.11; 181/161, 162; 116/137 A; 367/14, 140

See application file for complete search history.

(56) References Cited

U.S. PATENT DOCUMENTS

| | | | | |
|---|---|---|---|---|
| 5,137,110 | A * | 8/1992 | Bedard et al. | 181/153 |
| 5,864,517 | A * | 1/1999 | Hinkey et al. | 367/145 |
| 7,707,938 | B2 * | 5/2010 | Hisel | 102/302 |
| 7,918,309 | B1 * | 4/2011 | Vierra et al. | 181/161 |
| 2008/0121097 | A1 * | 5/2008 | Rudakevych et al. | 89/28.05 |
| 2009/0241794 | A1 * | 10/2009 | Eggers | 102/302 |
| 2011/0139029 | A1 * | 6/2011 | Farizy et al. | 102/322 |

* cited by examiner

*Primary Examiner* — Mark Hellner

(57) ABSTRACT

The invention comprises a device and method of using said device(s) including but not limited to; Long Range Acoustical Devices (LRAD), Hyper Sonic Sound (HSS), Cascaded Linear Array Systems (Clas and BClas) and or HyperSpike devices currently and typically used for sonar, acoustic hailing, crowd control, mass notification, and sonic boom simulation—to initiate avalanche release in or in proximity to avalanche corridors and starting zone(s) as a non-explosive control alternative. The invention is an integration of technologies incorporating an infrasound generator, on board power supply and amplification, inverter, digital signal processor, GPS, and RF receiver all housed in a rugged weather resistant enclosure with necessary gantry and rigging. The combination of these technologies allows control personnel to safely operate the equipment from a remote location. The invention is deployed remotely via a cable or network of cables to predetermined avalanche starting zone(s). The device can be rotated, panned the full length or range of the cable(s), and tilted offering users comprehensive coverage of any topography. The invention can readily be integrated with equipment and infrastructures already in use such as bomb trams, cable and pylon networks, helicopters, chairlifts, and sensing and notification systems. New infrastructures can be built to tailor fit any and all topographies and avalanche control programs for ski resorts, Departments of Transportation, transportation entities, and national parks.

11 Claims, 7 Drawing Sheets

NON EXPLOSIVE PROCESS AND DEVICE FOR TRIGGERING AN AVALANCHE

FIELD OF THE INVENTION

The subject invention concerns a method of initiating an avalanche in which a non-explosive triggering device; an electric acoustic device, is deployed into a predetermined avalanche zone or zones in which the avalanche is to be initiated.

A device is also described for the use of this method to initiate an avalanche, including means of generating resonance that overcomes the attenuation of the snowpack in a predetermined zone or zones in which the avalanche is to be set.

REFERENCES CITED

| | | | |
|---|---|---|---|
| 1,446,664 A | February 1923 | Saucier | |
| 2,416,077 A | February 1947 | Yuster | 102/20 |
| 2,656,003 A | October 1953 | Poulier | 181/5 |
| 2,674,945 A | April 1954 | Marsh | 102/28 |
| 2,972,948 A | February 1961 | Kray | 102/56 |
| 3,129,665 A * | April 1964 | Evans, Jr. | 102/476 |
| 3,477,372 A | November 1969 | McFerrin et al. | 102/24 |
| 3,664,262 A | May 1972 | Rose et al. | 102/56 |
| 4,023,494 A | May 1977 | Barton et al. | 102/24 R |
| 4,187,782 A | February 1980 | Grace | 102/56 |
| 4,259,906 A | April 1981 | Krauch, Jr et al. | 102/56 SC |
| 4,455,914 A * | June 1984 | Christmann et al. | 102/476 |
| 4,499,830 A | February 1985 | Majerus et al. | 102/476 |
| 4,794,990 A | January 1989 | Riggs | 166/902 |
| 4,817,529 A | April 1989 | Schippers | 102/302 |
| 5,107,765 A | April 1992 | Schippers | 102/302 |
| 5,162,885 A | November 1992 | Hunt et al. | 257/55 |
| 5,259,317 A | November 1993 | Lips | 102/307 |
| 5,705,768 A | January 1998 | Ey | 103/307 |
| 5,847,312 A | December 1998 | Walters et al. | 102/309 |
| 5,864,517 A | January 1999 | Hinkey et al. | 367/145 |
| 5,872,326 A * | February 1999 | Manhart | 102/439 |
| 6,279,481 B1 | August 2001 | Schippers | 102/302 |
| 6,324,982 B1 | December 2001 | Eybert-Berard | 102/363 |
| 6,597,309 B1 | July 2003 | Panton | 342/134 |
| 6,644,203 B1 | November 2003 | Powell | 102/315 |
| 6,786,157 B1 | September 2004 | Powell | 102/476 |
| 7,454,030 A | November 2008 | Graber | 381/341 |

* cited by examiner

OTHER PUBLICATIONS

"Military Artillery for Avalanche Control", Doug Abromeit—The Avalanche Review January 1990.

"Insight into Slab-Avalanche Triggering", Francois Louchet and Alain Duclos—The Avalanche Review February 2006.

"Explosive-Residue Compounds Resulting From Snow Avalanche Control in the Wasatch Mountains of Utah", U.S. Geological Survey—Water-Resources Investigations Report 03-4007

"BNSF Denied Avalanche Blasting In Glacier Park", Keriann Lynch—Flathead Beacon Nov. 10, 2008

"Recent Progress in North American Avalanche Forecasting and Control", E. R. LaChapelle—United States Forest Service, 1960

BACKGROUND OF THE INVENTION

This invention relates to an electronic device able to produce high amplitudes and low frequency longitudinal waves with sufficient intensity to overcome the attenuation properties of a snowpack, thus creating a geometrical resonance in the snowpack's framework, ultimately collapsing the weak layer, and here by initiating an avalanche.

Longitudinal waves created by sonic booms with Sound Pressure Levels (SPL) of magnitudes equal to or greater than 133 to 150 dB or 2 to 13 pounds Per Square Foot (psf) have proven to be capable of causing snow avalanches. One example of an existing technology in use worldwide using overpressures to initiate avalanche release is Gaz-Ex exploders. These exploders produce overpressures up to 162 dB or 52 psf and due to the fact they are explosive there is an accompanied shock wave. There currently are no known acoustic devices in use to deliberately initiate snow avalanches.

An example of a commercially available acoustic device (subwoofer) capable of generating high amplitude low frequency SPLs is the TH 221 from Danley Sound Labs. While this subwoofer is in fact capable of producing peak overpressures up to 144 dB/6.6 psf it is too big and too heavy to be considered for avalanche control.

Avalanches can present serious dangers to persons and or property when triggered in an uncontrolled manner, whether by natural causes such as weather conditions or unintentionally as a result of human activity such a skiing or hiking. Therefore the continuous maintenance of avalanche control programs worldwide has become well established.

Control techniques can be divided into two main categories; passive and active. Two examples of passive techniques include the construction of terraced barriers on the mountain slopes designed to pin the snow layers thus preventing slippage and the construction of snow dams at the base of the slope intended to divert avalanche run outs from structures considered to be at risk. Active techniques such as launching artillery from Howitzers or Avalaunchers, placing explosives by hand, heli-bombing, and cross cut skiing are all common practices carefully coordinated with weather system surveillance, local condition forecasting, infrasonic sensing, and notification systems all designed to induce controlled artificial avalanche releases.

The practice of regularly triggering small, controlled releases is intended to minimize the buildup of snow in known starting zones which, if left uncontrolled would eventually release naturally. Such natural releases of large volumes of snow can accumulate into massive slides ultimately causing extensive damage to services, infrastructures, a variety of property and people. Every year approximately 30 people are killed by avalanches, worldwide.

This invention supports active methods of avalanche control and in particular is intended to replace a number of explosive practices currently in use today. The safest explosive method is known as Gaz-Ex in which a large divergent tube is constructed in known starting zones and is aimed downward toward the snowpack. A mixture of oxygen and propane is ignited inside the tube by a remote management system. The resulting shockwave from the explosion above the snow surface stimulates a controlled release of the snowpack. It is well documented that an explosion or overpressure that meets or exceeds 52 psf. just a few feet above the snow surface is the most effective method of avalanche initiation.

There have been substantial advancements in pyrotechnic delay fuse technology and the designing of shaped charges to increase the effectiveness of the explosive charges and increase the safety for control personnel. Widely in use today in alpine countries in Europe are Wyssen towers and Doppelmayr bomb trams. These systems of pylons and cable networks deploy explosives into inaccessible regions and allow for safe remote and or timed delay fuse detonation of explosives over predetermined starting zones. Regardless of newer, more effective, and safer developments however the industry is still in danger of untimely detonations and subject to rigorous transportation, storage, and handling procedures enforced by the United States Army and Homeland security.

The use of explosives of any kind presents inherent dangers to control personnel regardless of the strict protocols in place to hedge these dangers. In recent years some national parks have banned the use of explosives. Transportation entities for example, BNSF Railroad have been forced to spend millions rebuilding snow sheds, tunnels, and bridges damaged by wildfires to protect their transportation routes due to the banning of explosives in Glacier National Park. In the avalanche community it is unanimous that a satisfactory alternative be identified sooner than later.

Compounding the known dangers of explosives use the United States Geological Survey (USGS) has conducted surveys in the Wasatch Mountains of Utah where explosives are used for avalanche control to determine the concentration of explosive compounds in snow, soil, and lake-bottom sediment. While the Unites States Environmental Protection Agency (USEPA) has set health advisories for four of the explosive-residue compounds found in snow samples it is not a legally enforceable standard.

The USGS and USEPA use two benchmarks to measure the cancer risk threshold: (1) $10^{-4}$ cancer risk, which is the concentration of a chemical in drinking water corresponding to an estimated cancer risk of 1 in 10,000; and (2) HA, which is the concentration of a chemical in drinking water that is not expected to cause any adverse non-carcinogenic effects for a lifetime of exposure. Up to seven explosive compounds were found to be present in the samples tested although all compounds were found to be in quantities under the above mentioned safety thresholds. None the less these studies are raising the eyebrows of many that live, work, and play in and near these wilderness areas.

SUMMARY OF THE INVENTION

The present invention offers a solution to all of the above mentioned disadvantages and describes a method to initiate avalanches in any and all topographies considered to be avalanche control areas.

One example of a configuration of the invention comprises a pair of infrasonic generators (Fi BTL-N315 or equivalent subwoofers) positioned contiguously with one another in a housing with the aperture or mouth of the housing of each facing in a downward fashion so as to direct the high amplitude pressure waves toward the snow surface. The apertures of the generator's housing is where the longitudinal/compression waves are released into the environment. One example of a pan and tilt and fully rotatable housing and gantry system described below allows for the "aiming" of fore mentioned compression waves. The generators are contained in a suitable housing made from high density woods, High Density Polyethylene (HDPE), and or carbon fiber. Mounted permanently or semi-permanently (with tie-down straps and holes in the housing's frame to accept the hooks from the straps) to the top of the generator's housing is a ruggedized Pelican case or equivalent to house all on board electronic components comprising; power supply, inverter, amplifier(s), and an RF receiver which are all permanently mounted to Raxxess rack rails inside the case to prevent shifting and subsequent damage.

In this embodiment the power supply; a 12 VDC Lithium Ion 100 amp/hour battery or equivalent manufactured by Smart Battery is positioned inside an industry standard, rigid, hard, plastic battery case which is fixed to the rack rails. Fastened to the positive and negative posts of the battery are (2) 18" 2awg cables (1 cable to each post) that reach to the respective positive and negative terminals of the DC to AC inverter. An AIMS 12 VDC/120 VAC modified pure sine wave inverter (PWRI500012S or equivalent) powered by the battery is mounted to the rack rails as stated previously to provide clean stable AC power for the RF receiver and amplifier(s) which in turn power the infrasound generators. The RF receiver (the ULXP4 system for example) manufactured by Shure receives digital signals (from the remote transmitter) and sends these digital signals to the amplifier for digital to analog signal processing. The receiver too is permanently mounted to the rack rails and is plugged into one of the available AC power outputs of the power inverter. Mounted to the rack rails directly below the power inverter is a QSC Class D amplifier (PL380 PowerLight or equivalent). The amplifier converts digital signals received from the wireless RF receiver and converts them to analog and sends these signals to the generators via a pair of SpeakON cables. The amplifier power cord also plugs into one of the available AC outputs of the power inverter. The main outputs of the amplifier each receive a SpeakON cable that plug directly into each respective generator's SpeakON input. The SpeakON cables carry the analog signals from the amplifier to the generators that in turn produce the acoustic compression waves.

Opposing ends of the housing for example could be provided with slave gears to be met with a pair of powered gears at either end of the housing's balanced pivot point or X-axis. For example a lower gantry is equipped to either side of the housing's pivot points providing a fixed position for a pair of electric motors fitted to either side with respective drive gears to tilt the device around the X-axis. Both Sides of the lower gantry would meet above the housing at the balanced center or Z-axis and be equipped with a slave gear to be met with its respective drive gear for example. A median gantry might have a fixed electric motor fitted with a drive gear to drive the slave gear on the top of a lower gantry, thus rotating the device and housing around the Z-axis. Fixed to the median gantry could be a winch(s) equipped with a length of cable(s) that ascend to an upper gantry or other configuration to prevent uncontrolled spinning while allowing the operator to raise and lower the equipment along the Z-axis. A set of pulleys equipped with small electric motor(s) for example could allow the deployment of the device along any length of cable or cables on the X-axis. All drive motors and associated components shall receive power from the onboard power supply and inverter.

The compression waves propagated by the generators of sufficient intensity can overcome the attenuation properties of the snow. The waves disrupt top or upper layers and penetrate the snowpack lower layers causing a forced harmonics and or a sympathetic resonance within the snowpack framework causing the geometry to vibrate and collapse. With this collapse the snow can no longer support its own weight and being subject to gravity the avalanche is initiated.

The invention is deployed into predetermined starting zones manually and or automatically using wireless RF communication systems operated by a control operator(s) in one example; a single line of ½6×19 stainless steel wire rope is stretched between two trees/rocks, or engineered pylons installed into the bed rock in the flanks of the avalanche starting zone using heavy duty rigging loop slings and a heavy duty chain come along. In this embodiment a CMI RT trolley can be incorporated to allow pulling the generators and associated equipment along the length of wire rope to and from either side of the starting zone using only two lengths of heavy duty nylon rope. A Warn electric winch w/wireless remote for example can be fastened with a plurality of wire ropes and class "D" carabiners to the trolley, and operated from either flank to ascend and descend the generators. Yet another plurality of wire ropes and class "D" carabiners are fastened to the generator's housing and the winch cable. The winch plugs into the fore mentioned inverter for power. In another example a more elaborate system best described as a reeving positioning system as described in U.S. Pat. No. 7,239,106 B2 is ideal for larger autonomous applications; affords control operators the luxury of autonomous fluid positioning of the generators and associated equipment anywhere in 3-dimensional space (within the limits of the system of course). The apertures of the acoustic device(s) can be positioned to any height above the snow surface (within the limits of the system installation) and aimed or positioned in any manner deemed necessary by the operator. The present invention allows unparalleled control of the pressure waves with limitless proximity potential. The invention boasts far reaching signal processing capabilities with NCH Tone Generator software for example; allowing the operator in real time to focus or oscillate through a range of frequencies, vary the frequency modulation and intervals, and position the equipment almost anywhere in three dimensional space using reeving technology. Currently there is not a solution in the industry that can come close to offering the range of options and potentials the present invention offers. Additionally, the present invention is non-explosive and is environmentally neutral.

This invention can be integrated with numerous technologies already in place and or in existence. For example, the present invention can be integrated with existing bomb trams, GPS systems for exacting deployment, on board power supply, inverter, video, and sensing systems, digital signal processing equipment, notification and sensing software programs and computer platforms, robust remote technologies for manual and autonomous operations, as well as elaborate reeving technologies used typically to navigate cameras anywhere in a three dimensional space at stadiums and live events.

Avalanche control happens to be only one market the present invention can be used for. For example this system can be used to eradicate bark beetles from forested areas. With digital signal processing and the implementation of forced harmonics and or sympathetic resonance and the appropriate frequency amplitude and modulation the beetles could no longer find their present residence livable.

In another example the invention can be used in agricultural areas for the elimination of nuisance rodents, birds, and even insects from a given area. Extremely low frequency pulses can be generated below human hearing levels while making the "treated" area a haven for thriving plants and a dead zone for unwanted animals and insects.

To protect animal trainers and animal handlers this invention can be used to alert or "communicate" with the animal(s) in turn protecting humans from a would be assault or even death due to an attack.

While the subject invention can be deployed on land it could also be used in under-sea applications. Using the appropriate frequencies in conjunction with proper placement of the apparatus whales will no longer beach themselves and sharks could be prevented from entering waters where people like to enjoy surfing, swimming, and the like.

Furthermore, the present invention can be used for calibrating seismic sensing equipment that is commonly used in mining, nuclear testing, and avalanche mitigation.

Still another example where the invention might be used is at large stadiums and or live performance venues where low frequency and high modulation of a digital signal(s) is desired to round out the overall sonic experience for the listener.

In another example this invention could even be used for crowd control. Extremely low frequencies combined with very high sound pressure levels can deter would be attacker(s) from approaching beyond a certain point for instance.

The present invention can be used to power heating and cooling systems through a process known as thermo-acoustic generation.

DETAILED DESCRIPTION OF THE PREFERRED EMBODIMENT

Figure 1:
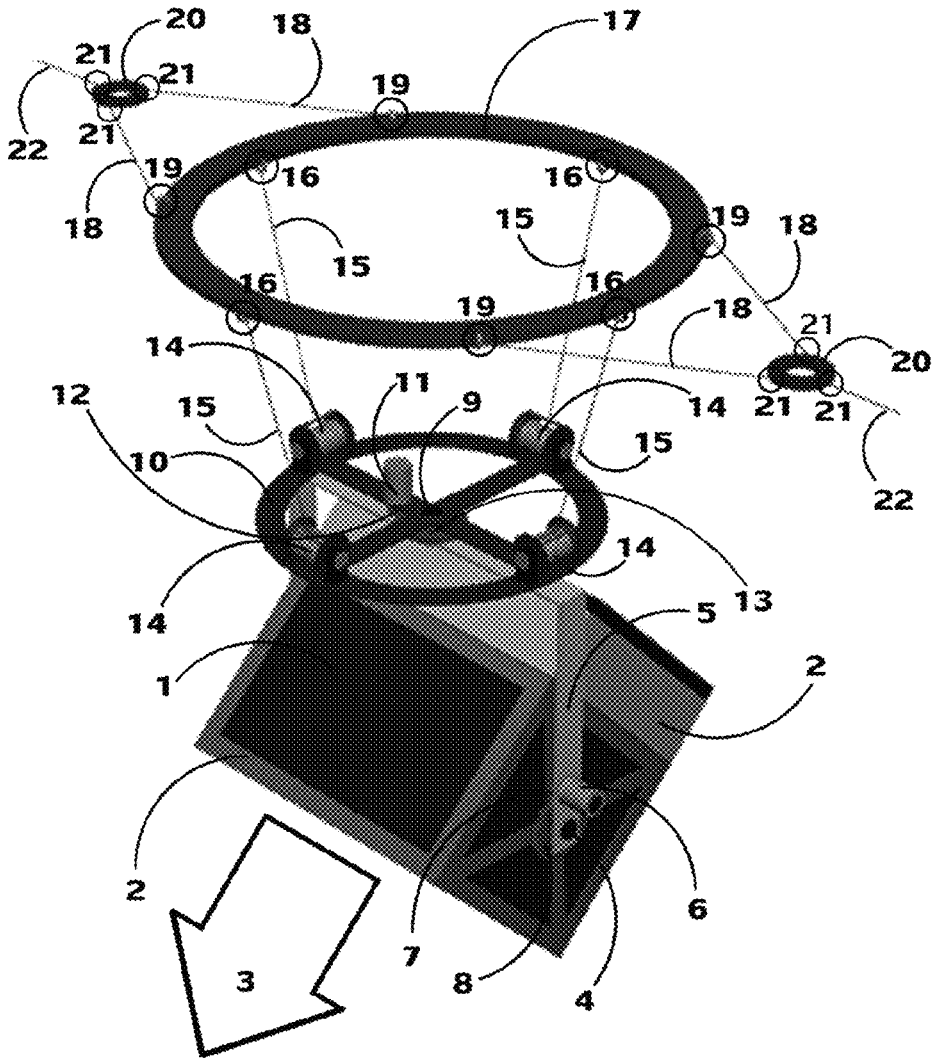
FIG. 1 is a close up view of the invention as it might be configured to be used for avalanche control work.

With reference to FIG. 1, the apparatus comprises an acoustic device 1 inside a suitable housing 2 so as to allow the sound generated by the acoustic device 1 to enter the environment unrestricted 3. In the present case the housing 2 is pivoted 4 by means of a lower gantry system 5. To either side of the lower gantry 5 in this figure are electric motors 6 each fitted with a drive gear 7 that turns a slave gear 8 which rotates the acoustic device 1 and housing 2 around an axis.

Attached at an appropriate pivot point 9 of the lower gantry 5 is an upper gantry 10 equipped with an electric motor 11 provided with a drive gear 12 which turns the lower gantry's slave gear 13 that rotates the lower gantry 5, acoustic device 1, and housing 2 around an axis 9.

Also in this figure, mounted to the upper gantry 10 is a network of winches 14 each equipped with a length of cable 15 and hooking apparatuses 16 which attach the above described embodiment to a system stabilization component 17 that is appropriately supported by a number of stabilizing cables 18 by means of hooking apparatuses 19. The stabilizing cables 18 from either side of the stabilization component 17 converge to a buckle 20 and are attached again by means of hooking apparatuses 21. Opposite the stabilizing cables 18 extending from both of the buckles 20 is a length of cable 22 attached to the buckle 20 with appropriate hooking components 21.

The apparatus described above by way of an example of the invention can obviously undergo numerous modifications and or variations. For example, a single length of cable 22 could be descended by a length of cable 15 that might correspond to a single winch 14 assembly for raising and lowering the above described configuration. The entire gantry system could in fact be abandoned for a more cost conscious and streamline deployment where topography might permit.

Figure 2:
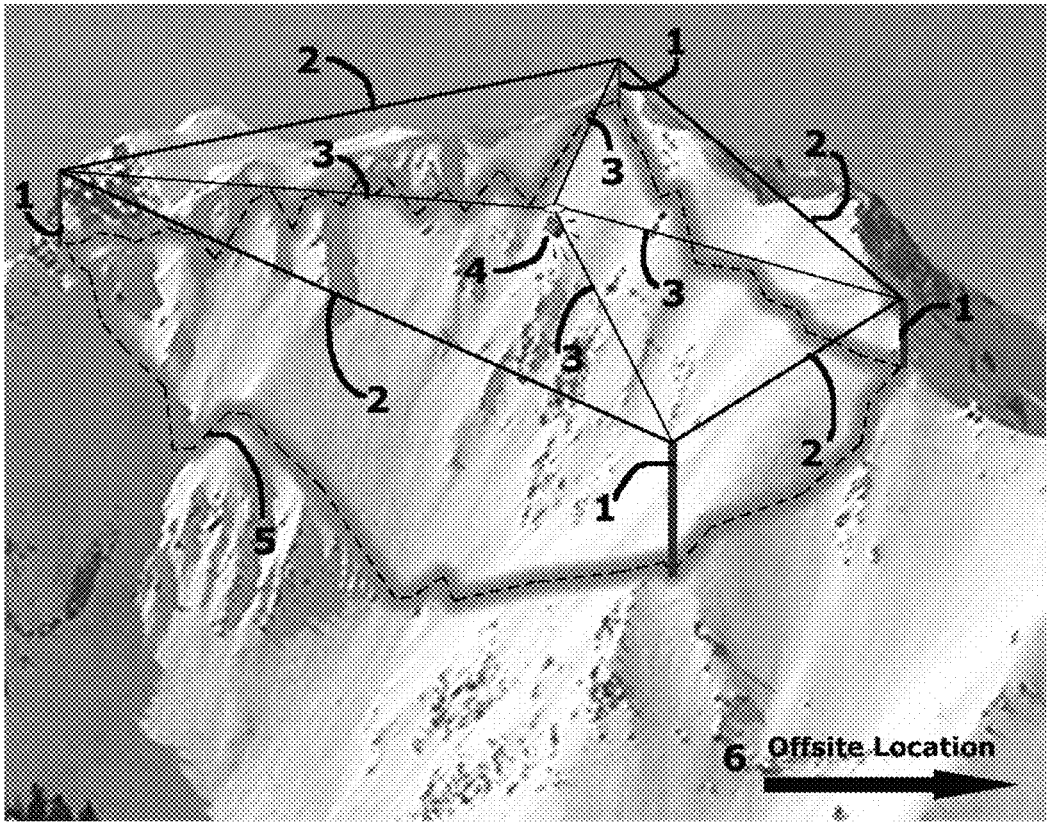
FIG. 2 is a perspective view of the invention as it could be configured on a mountain side

FIG. 2 shows the invention incorporated with a reeving system U.S. Pat. No. 7,239,106 comprising a plurality of pylon towers 1 that support the system and house the network of cables 2 and 3. The cables 2 and 3 make it possible to position the infrasound generators and associated equipment 4 anywhere in three dimensional space from a remote location 6 with "XYZ" axis control within the limits of the system 5. Reeving technology makes it possible for a single device 4 to control vast areas of geography 5 in this case a mountainside typical of avalanche control work; from a remote location 6 that could be a vehicle, nearby control station, or an operations center many miles away.

Figure 3:
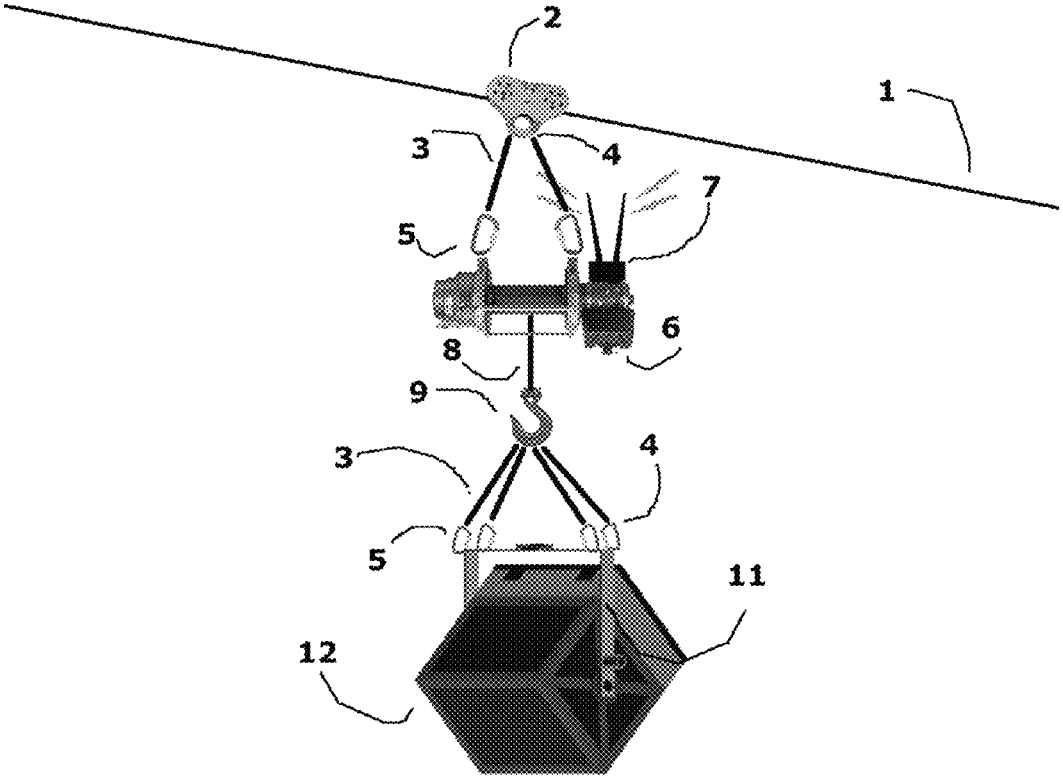
FIG. 3 is a close up view of an embodiment of the invention

FIG. 3 shows a close up view of the invention as it could be configured using a single skyline 1 as the fundamental means of deploying the device 12 safely into an avalanche starting zone with "XZ" axis control. The cable trolley 2 makes it possible to pull the device on the "X" axis along the length of cable 1. Connected to the cable trolley 2 using thimbles and wire rope clamps FIG. 7 is a plurality of wire ropes 3 that support a wireless winch 6 using a plurality of carabiners 5, thimbles, and wire rope clamps FIG. 7. The winch 6 with onboard receiver 7 is operated from either starting zone flank FIG. 4 9 using a wireless transmitter FIG. 4 6 enabling the control operator to safely ascend and or descend the device 12 along the "Z" axis. The winch 6 is equipped with a length of cable 8 and a hook 9 to attach yet another plurality of wire ropes 3 comprising thimbles and rope clamps as illustrated in FIG. 7. This lower set of wire ropes 3 are attached to the gantry 11 equipped with holes to accept a plurality of carabiners 5, thimbles, and wire rope clamps FIG. 7. The gantry 11 makes it possible for the control operator(s) to rotate the device 12 around the "X" axis.

Figure 4:
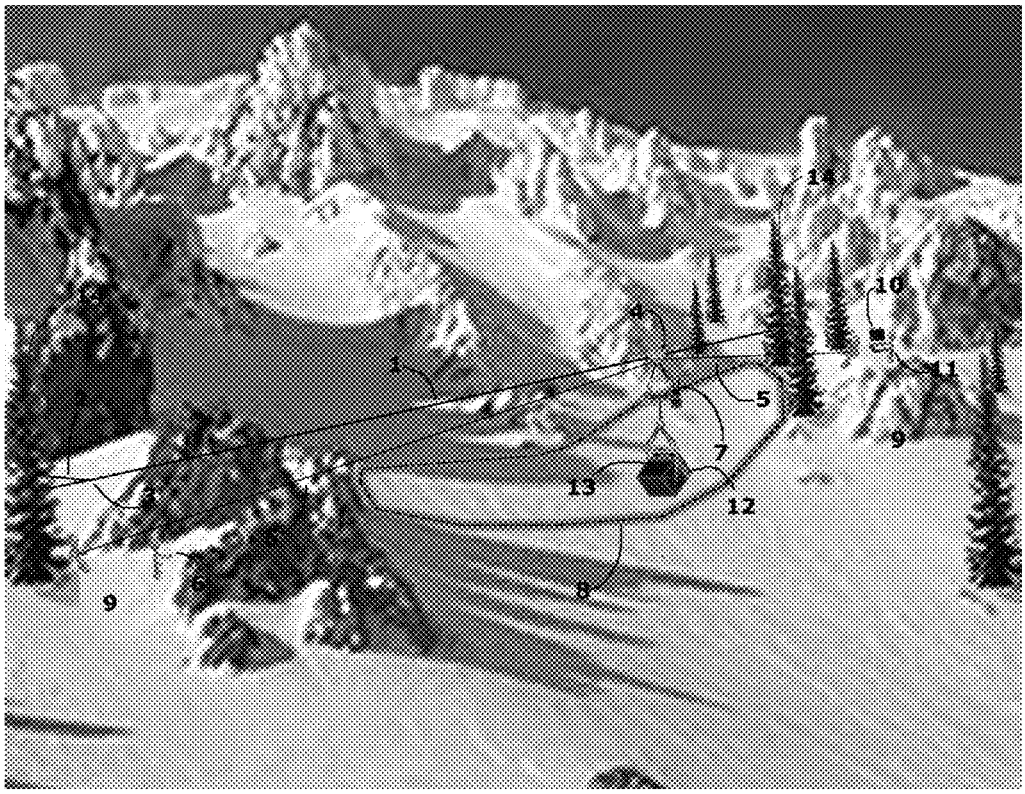
FIG. 4 is a perspective view of the invention as it could be configured on a mountain side

FIG. 4 is a perspective view of the present invention configured on a single skyline 1 that is stretched between a pair of trees 14 using a pair of heavy duty loop slings 2, thimbles, and wire rope clamps FIG. 7. The device 13, electronics 12, and associated components as described in FIG. 3 can be pulled along the "X" axis of the skyline 1 using a length of rope 5 from either starting zone flank 9 to do control work anywhere between the two trees within the limits of the system 8. The control operators can ascend and or descend the device 13 from either flank 9 using a wireless remote 6 and receiver 7 to control the electric winch FIG. 3 6. Control operators can operate the device 13 from either flank 9 using a laptop computer 10 with installed control software connected to a body pack transmitter 11 that communicates with the onboard electronics 12.

Figure 5:
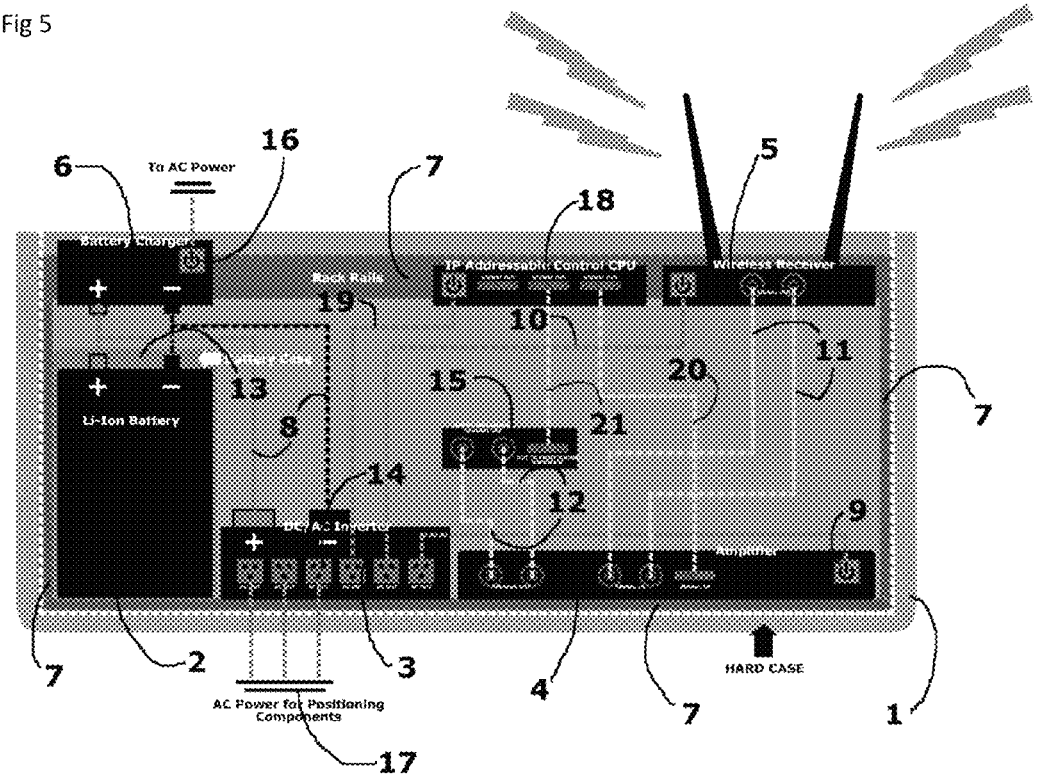
FIG. 5 is a detailed cross-section of the on board electronics

FIG. 5 is a cross-section of the onboard electronics box comprising; a ruggedized weather proof enclosure made of carbon fiber or equivalent composite 1 a 12 VDC lithium-ion battery power supply 2 that is housed inside an industry standard hard plastic battery case 13. The battery 2 is connected to a pure sine wave inverter 3 using a pair of 2awg cables 8. The inverter converts the DC power from the battery 2 to clean AC power for all associated onboard electronic and control components. The inverter is equipped with a plurality of industry standard 3-pin IEC power receptacles 14 to receive the power cables from each respective component. The wireless receiver 5 receives power from the inverter 3 via a power cable 10 and digital audio signals from a remote computer FIG. 6 1 and wireless transmitter FIG. 6 3 and sends the digital audio signals to the amplifier 4 via a pair of XLR cables 11. The amplifier 4 receives power from the inverter via a power cable 9 and converts the digital audio signal(s) received from the wireless receiver 5 to analog audio signal(s) and sends the analog audio signals to the generators FIG. 1 1 using a pair of SpeakON cables 12 and connectors 15. The ruggedized electronics box 1 is equipped with a pair of SpeakON connectors that connect directly to the infrasound generators FIG. 1 1. An IP addressable control CPU 18 receives power from the inverter 3 via a power cable 19 and receives all positioning data from the control computer FIG. 6 1 wirelessly on an IP network and sends this data using an RS 232 serial cable 21 to the positioning hardware. All positioning hardware receive AC power supplied by the inverter 3, 17. The control CPU 18 can simultaneously receive digital audio signals from the control computer FIG. 6 1 and send them to the amplifier 4 for analog processing using an RS 232 serial cable 20 eliminating need for the wireless transmitter and receiver. The IP network makes it possible for control personnel to operate the system remotely and autonomously from anywhere on Earth. A battery charger 6 is included to recharge the lithium-ion battery 2 when the system is cached. The battery charger 6 receives AC power from other source; vehicle, generator, grid tied power supply or other via equipped power supply cable 16. All enclosed electronic components are securely fastened to the inside of the enclosure using industry standard rack rails 7 to eliminate any shifting and subsequent damage.

Figure 6:
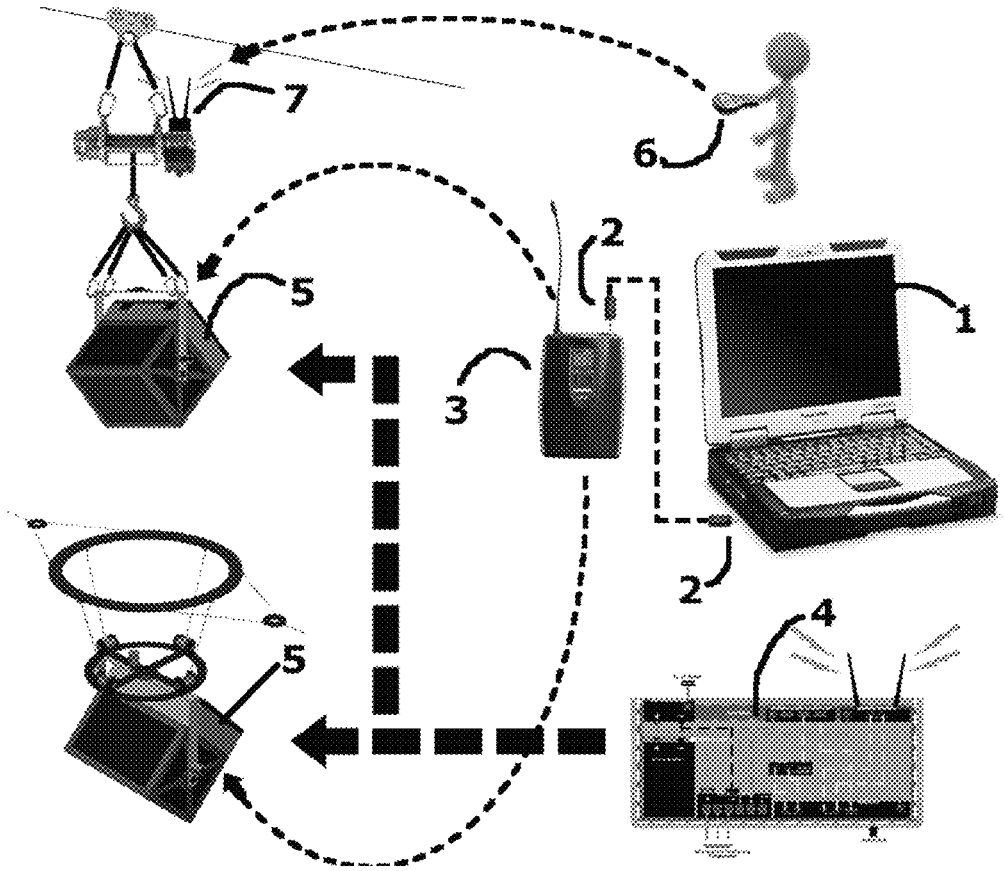
FIG. 6 is a schematic of the control hardware and wireless component technologies of the system
Figure 7:
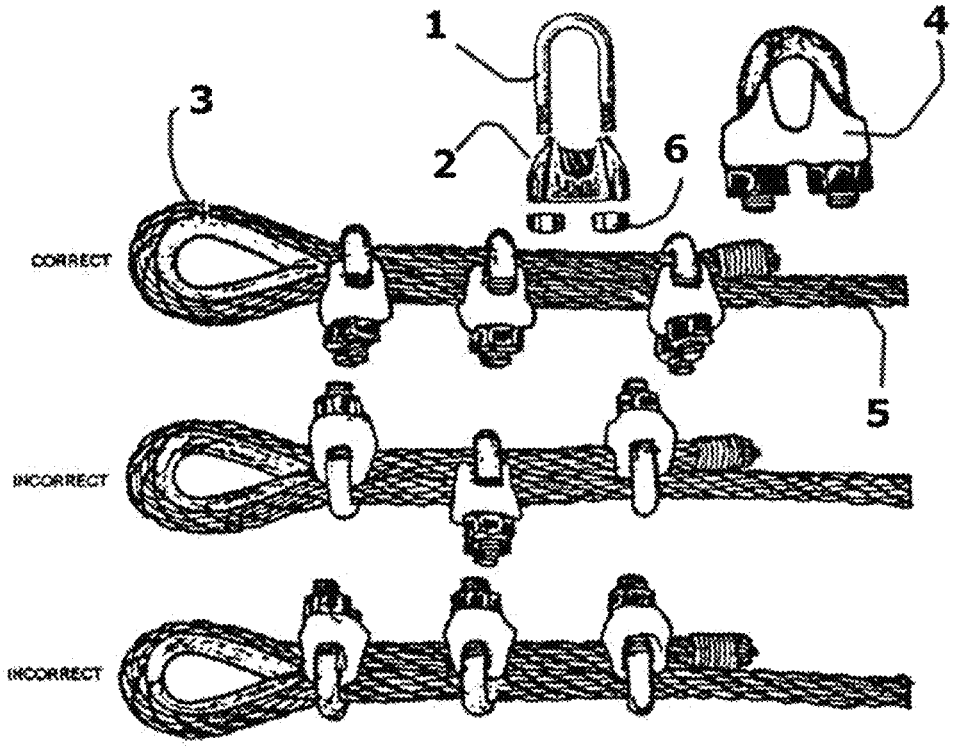
FIG. 7 is a drawing showing the correct and incorrest way to fashion cables for rigging

FIG. 6 shows a schematic of the system as a whole. The control computer 1 a laptop for example can be used to communicate directly with the onboard CPU FIG. 5 18 for wireless delivery of all audio and positioning data on an IP network and or in conjunction with the body pack transmitter 3 which is connected using a 3.5 mm audio cable 2 to transmit audio signals to the onboard wireless receiver FIG. 5 5. A wireless remote 6 is shown being held by a control operator to communicate with the winch receiver 7 for ascending and descending the device 5 when using single skyline configurations FIG. 4 1. The cross-section of the electronics box 4 is shown in the lower right corner and is mounted onboard the system 5.

FIG. 7 shows a close up view of how the wire rope 5, thimbles 3, and clamps 4 are to be used in the embodiments described herein. The wire rope 5 is looped through the associated hardware; carabiners, loop slings and the like, around a thimble 3, and then clamped to itself 3 consecutive times with wire rope clamps 4. The clamps are comprised of a saddle 2 and a threaded U-bolt 1 to accept a pair of nuts 6 so as to be able to tighten upon the wire ropes 5 that are passed through the clamp 4. The wire rope clamps 4 illustrated herein are industry standard and the top embodiment shows the "correct" manner in which to use the clamps.

The invention claimed is:

1. An electronic acoustic device as described in the preferred embodiment used to generate acoustic waves with sufficient pressure to initiate avalanches comprising;

(a) An acoustic device capable of generating high amplitude low frequency longitudinal waves as described in the specification; a person skilled in the art or science to which it pertains is handily capable of implementing and or otherwise operating said equipment;

(b) One skilled in the art can acquire and configure an on board amplifier, RF receiver, power supply, and inverter as illustrated in the drawings and specification;

(c) As defined in the specification a housing and gantry system to protect and maneuver the acoustic device and on board electronic equipment can be easily assembled, put in to service, and operated as intended by persons in the field;

(d) The apparatus to deploy and position the system into a predetermined area as characterized in the summary of the invention and associated drawings is common to persons skilled in the art and profession accordingly a high level of proficiency is assumed;

(e) A common computer or equivalent user interface to operate the electronic equipment can be operated by anyone with minimal computer experience much less skilled in the art; wherein digital signals recorded or in real time are transmitted by radio frequency to the digital signal processor that is in communication with the acoustic device would likewise be quickly enabled by anyone experienced or otherwise skilled in the art or science in which it pertains.

2. The device of claim 1, wherein internal transducers and wave guide construction of the acoustic device are capable of outputting highly modulated frequencies while producing extremely high amplitude low frequency longitudinal compression waves of sufficient sound pressure levels to initiate avalanches.

3. The device of claim 1, wherein an onboard digital signal processor, receiver, power supply, and inverter are configured to communicate input signals electronically to the acoustic device.

4. The device of claim 1, further comprising a housing to protect the on board electronic equipment while the gantry allows an operator to meticulously maneuver the device in the predetermined area from a remote location.

5. The device of claim 1, wherein a simple or elaborate system of motors and cables are arranged to deploy the device into a predetermined location of any avalanche control area.

6. The device of claim 1, further comprising a computer or other user interface allows an operator to transmit digital signals recorded or in real time by radio frequency to the on board receiver and signal processing equipment that is in calibrated electronic communication with the electronic acoustic device.

7. A method of using an electronic acoustic device to generate compression waves of sufficient power to initiate an avalanche comprising;

(a) Deployment of an electronic acoustic device into a predetermined location with the appropriate rigging apparatus configured to accommodate a given topography;

(b) Positioning and operating an electronic acoustic device in a predetermined area from a remote location by way of suitable gantry and rigging components, power supply, calibrated signal processing, and advanced remote technologies;

(c) Composing and inputting digital signals to an electronic acoustic device either by way of software, computer(s) and or digital signal processing so the output from the acoustic device will create geometrical resonance in the snowpack's framework, ultimately collapsing the weak layer, and here by initiating the avalanche;

(d) Incorporating existing sensing and notification systems to autonomously deploy, process, and operate all functions of the invention.

8. The method of claim 7, wherein the use of an electronic acoustic device comprises either a fixed mount or a network of cables and motors configured to deploy and position an acoustic device into a predetermined location within adequate proximity of a snowpack to cause an avalanche.

9. The method of claim 7, wherein the use of an electronic acoustic device is configured with a housing to protect all on board electronic equipment and a suitable gantry and rigging to allow an operator to have a full range of maneuverability; to pan, tilt, rotate, ascend, and descend the acoustic device in any predetermined location to accommodate all topography characteristics.

10. The method of claim 7, wherein the use of an electronic acoustic device further comprising: the input of digital signals from a computer or other user interface that is transmitted by radio frequency to the calibrated on board receiver and signal processor that are in communication with the acoustic device. The input signals must contain the appropriate frequency interval and modulation information to produce compression waves that will resonate with a given snow pack.

11. The method of claim 7, wherein the use of an electronic acoustic device is integrated with existing sensing and notification systems to allow autonomous deployment, processing, and operation of all the system's functions.

* * * * *